US005174775A

United States Patent [19]

Birch

[11] Patent Number: 5,174,775

[45] Date of Patent: Dec. 29, 1992

[54] RF CONVERTOR AND SWITCH

[75] Inventor: Norman R. Birch, Jacobus, Pa.

[73] Assignee: AMP Incorporated, Harrisburg, Pa.

[21] Appl. No.: 781,425

[22] Filed: Oct. 23, 1991

[51] Int. Cl.[5] ..... H01R 29/00

[52] U.S. Cl. ..... 439/188; 200/51.1; 439/581; 439/583; 439/609

[58] Field of Search ..... 200/51.1, 51.09; 439/188, 513, 578, 581, 583, 607, 609

[56] References Cited

U.S. PATENT DOCUMENTS 4,687,446 8/1987 Birch et al. ..... 439/553

5,030,122 7/1991 Birch et al. ..... 200/51.1

FOREIGN PATENT DOCUMENTS 0043977 2/1991 Japan ..... 439/188

*Primary Examiner*—Paul A. Bradley

[57] ABSTRACT

An RF connector switch (18) includes an outer metallic shell (19) containing a dielectric core (49) and contacts (64, 66) having ends (62, 68) in coaxial ports (21, 35). The contacts (64, 66) include second ends (62, 72) aligned with a port (44) in the shell (19) through which a pin (69) may be inserted to operate the ends (62, 74) as a switch.

5 Claims, 5 Drawing Sheets

RF CONVERTOR AND SWITCH

This invention relates to an RF connector switch for selectively interconnecting RF ports.

BACKGROUND OF THE INVENTION

A portable communication device such as a cellular telephone typically has two modes of operation. In one mode, the device is carried within a vehicle, and draws power from the vehicle source of power, and utilizes an antenna attached to the vehicle. In the other mode, the device is separated from the vehicle is hand carried to a place of use, while drawing on a portable source of power and having its own portable antenna. This creates a need for disconnecting and interconnecting the device from an antenna for transmission and reception.

Connectors for carrying RF energy capable of switching between RF ports are known. In the European Patent Application Publication Number 0 393 670, filed Apr. 19, 1990, there is disclosed an electrical connector for connecting electrical cable having multiple signal carrying conductors to provide a shielded bus for a local area network. The cable and connector are coaxial in nature and include an internal switch that interconnects RF paths when a mating connector is plugged in to engage such switch. When the mating connector is withdrawn, the contacts close to a resistor connecting the now unused port to the shielding structure of the connector.

It is also known to provide a segmented construction for electrical connectors and Pat. No. 4,687,446 granted Aug. 18, 1987 teaches such a structure. There, a coaxial device for handling RF energy allows tapping into a coaxial line through a structure having at least three ports, two in line and one operating as a T tap. There also, metallic shell elements and dielectric core elements are made in pieces which fit together to provide the necessary coaxial and shielded connector structure.

The present invention has as an object the provision of an improved coaxial RF connector switch. A further object is the provision of a connector switch structure which is capable of transmitting RF energy in a shielded structure of few parts which are readily assembled. Still a further object is to provide a simple and reliable device for supporting an antenna and selectively interconnecting such antenna to a coaxial port.

SUMMARY OF THE INVENTION

The present invention achieves the foregoing objects through the provision of a relatively heavy outer metallic shell made in two halves that internest to enclose an inner volume and provide shielding for such volume. A pair of dielectric core elements that fit together are configured to provide proper dielectric parameters for RF transmission and are fitted within the volume of the shell. The elements include interior surfaces to grip and position a pair of contacts that define signal paths. The contacts are each rounded on one end to form part of a coaxial port and be engaged by the signal conductor part of a coaxial connector. The contacts at the other end are flattened, and at least one of the contacts is made of a spring grade wire providing resilience allowing the contact to be deflected to disconnect the signal paths and to restore to make contact and provide a switch action. An aperture is provided aligned with the contacts to allow the insertion of an element in the form of a pin, which engages the spring contact and deflect such to effectively open the connection between RF ports. One of the RF ports, on the end of the device, is made relatively heavy and is internally and externally threaded to allow the device to be mounted in a bracket on electronic equipment which it serves, and at the same time, support an antenna fitted into the internal threading and held free-standing by the connector switch of the invention.

DETAILED DESCRIPTION OF THE INVENTION

Figure 1:
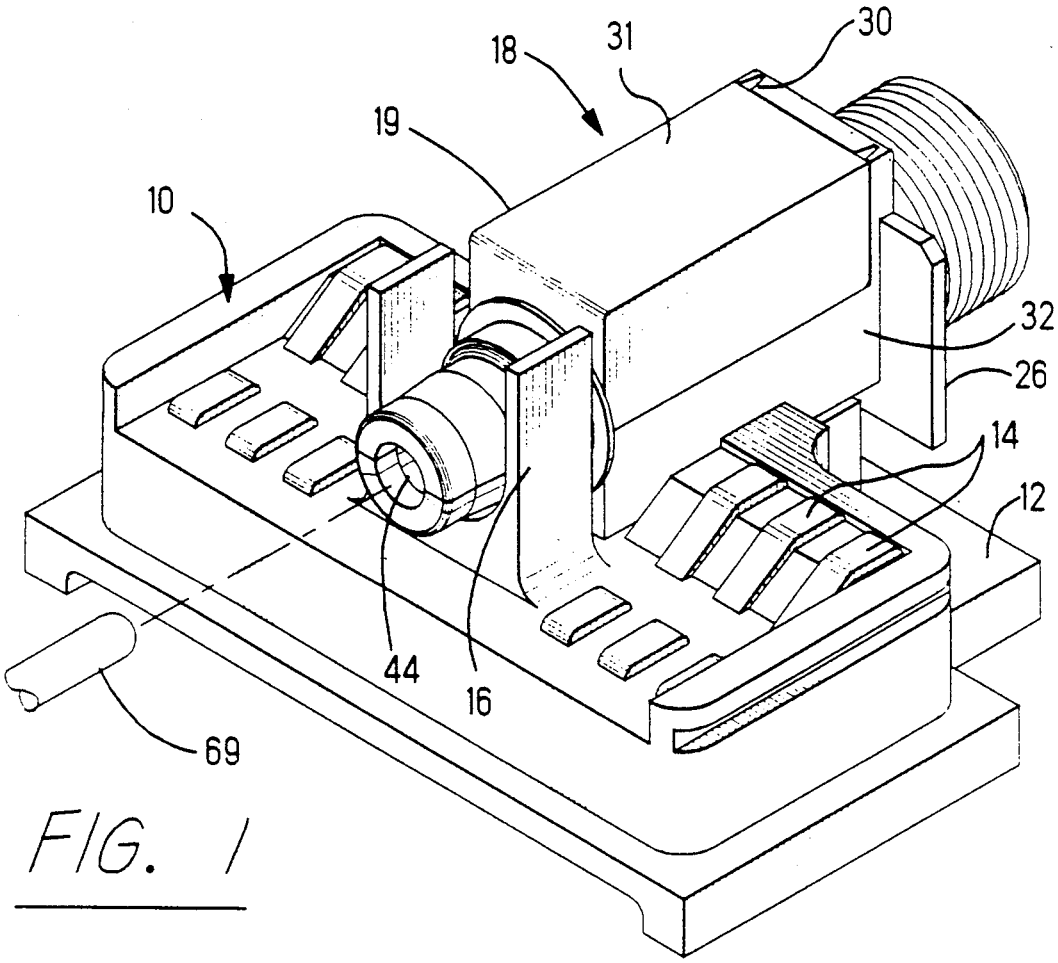
FIG. 1 is a perspective view of the invention mounted on a battery pack connector block.
Figure 2:
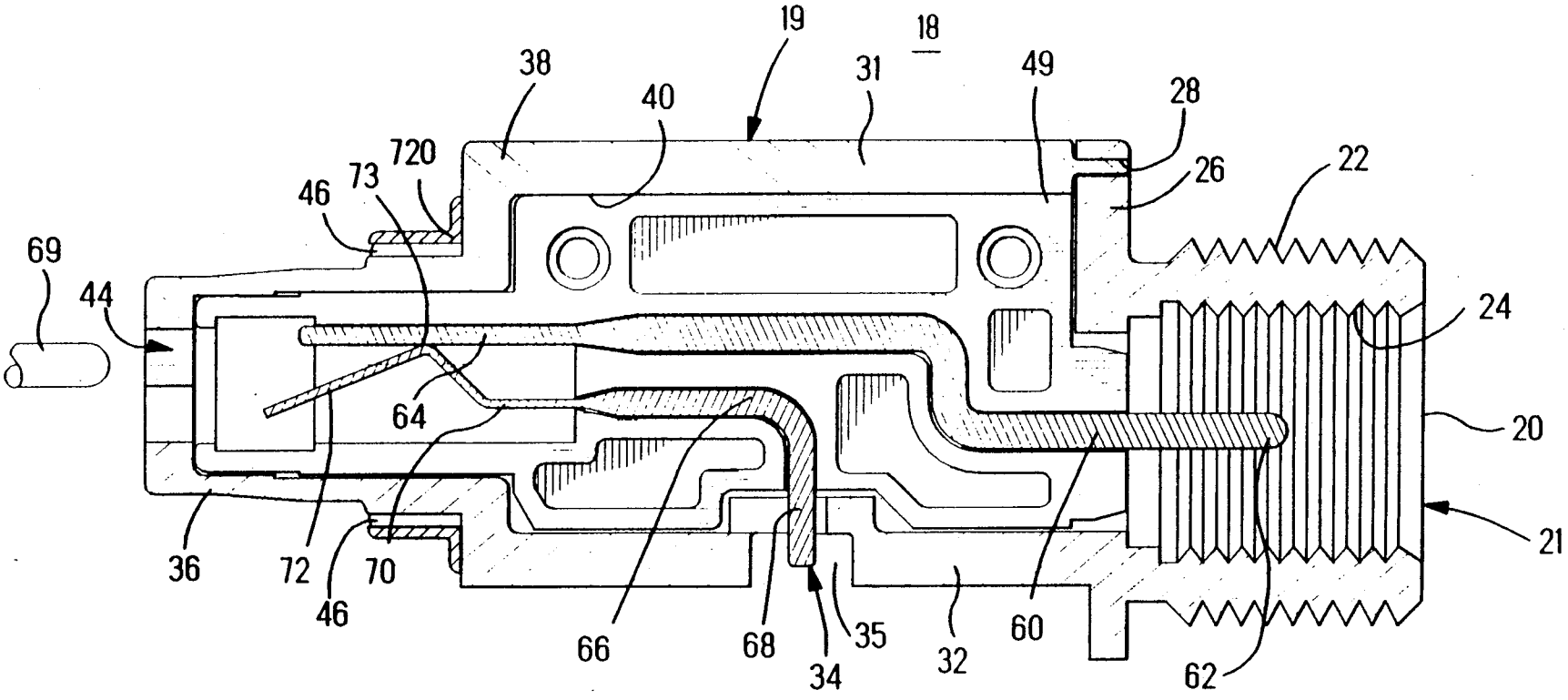
FIG. 2 is a side, elevational and partially sectioned view of the invention assembly.

FIG. 1 shows an assembly 10 comprised of a mounting block 12 which includes metallic contacts 14 and a bracket 16 adapted to receive, align and position the connector switch 18 of the invention. The block 12 is typically of insulating material and is utilized in conjunction with an electronic module (not shown) which may be typically a cellular telephone set and battery pack. The contacts 14 are utilized in conjunction with power or ground paths and can be utilized for signal interconnections, a battery pack, and/or the set employed in its portable, non-vehicular mode; or, alternatively, for interconnections to circuits of a vehicle. FIG. 2 shows the connector switch 18 of the invention to include a pair of coaxial ports 21 and 34 and a further port 44 relative to a pin 69 attached to an electronic package, not shown, for example, a cellular telephone set having the pin 69 entering port 44 to accomplish a switching function. As can be seen in FIG. 2, the connector switch 18 of the invention includes switch contacts 64 and 66, which are positioned to be normally closed interconnecting port 21 to port 34. The insertion of pin 69 axially into port 44 results in the pin 69 striking the flat end 72 of the contact 66 affecting a disconnect, the contact 66 being resiliently pivoted downwardly, breaking the connection between the two ports. At this time, pin 69 is connected to port 34 and port 21 is disconnected. In this particular use, port 34 may be considered to be an RF, coaxial channel to an electronic package or the modular telephone set, and port 21 may be considered to be an interconnection to a stub antenna, not shown, for use with the set when in its portable, non-vehicular mode of operation. Insertion of pin 69 results in disconnecting the port 21 for the stub antenna and interconnecting a vehicular antenna, not shown, to the port 34.

As can be appreciated, the interconnection of RF signals requires shielding to prevent radiation or "noise" from interfering with the signals by being coupled into the signal paths; and, prevents radiation from the signal paths to the surrounding environment. Also to be appreciated is the need to provide signal conduction, shielding and grounding, and a dielectric medium therebetween which is optimized for signal transfer at the frequencies employed. Additionally, in this particular application, the antenna structure, which is mated to the connector switch 18, is supported entirely by the interconnection with the connector switch 18. For that reason, the interconnection end 20 of port 21 is made of relatively thick metal to include a series of exterior threads 22 and a series of interior threads 24 of appreciable length to allow the threading in of a coaxial fitting of the stub antenna. Such fitting (not shown) would also include a center signal contact, which would engage an end 62 of the signal pin 60, FIG. 2. The exterior threads 22 are used to panel mount the assembly 10, to accommodate a nut (not shown) which allows the connector switch 18 to be mounted to a panel, not shown, by virtue of end 20 being inserted through an aperture in a panel with the nut threaded over 20 to hold the connector switch 18 to the panel.

Figure 3:
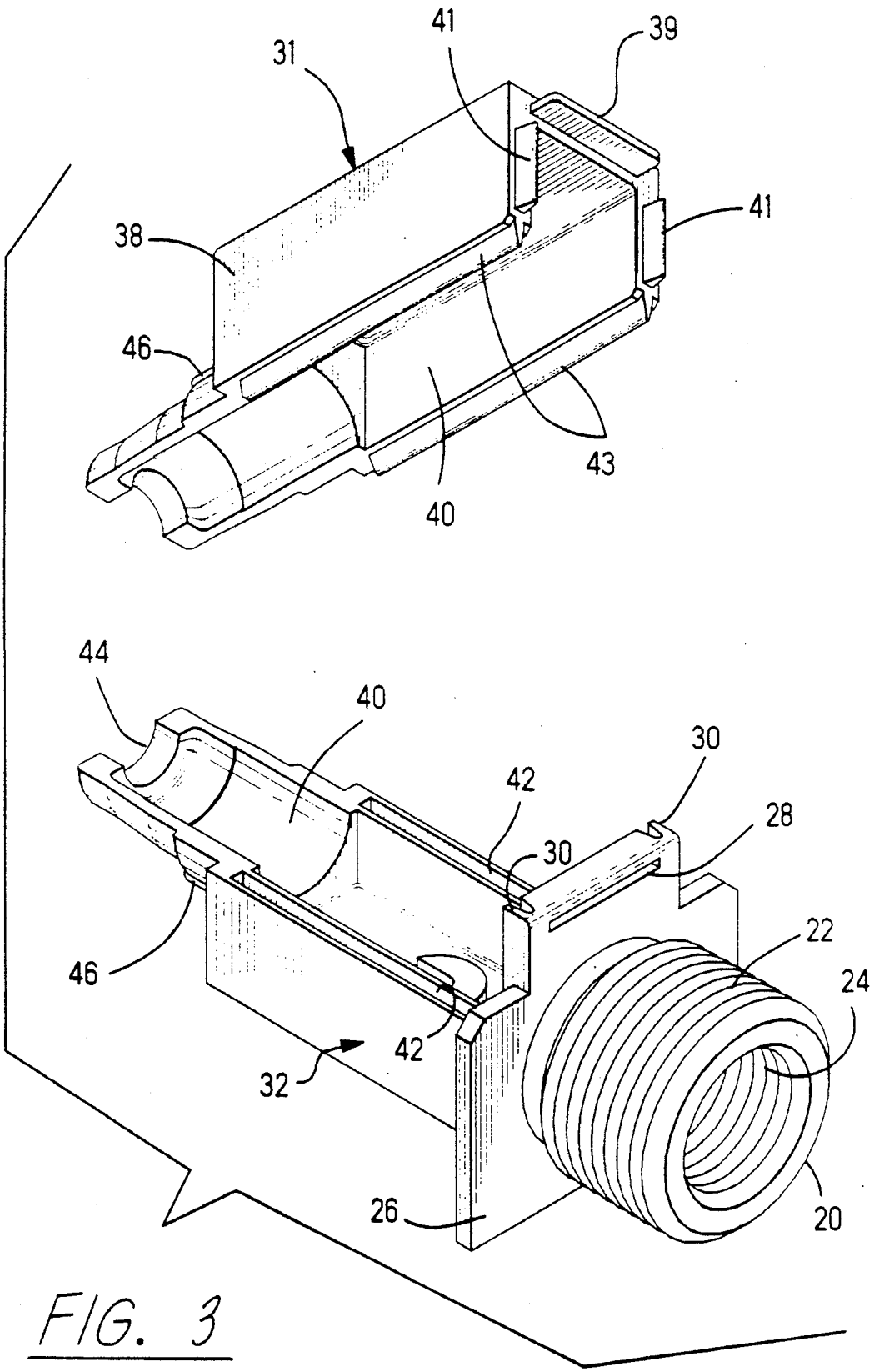
FIG. 3 is a perspective, showing exploded the two halves of the outer metallic shell of the connector of the invention.

As can be seen in FIGS. 1-3, the connector switch 18 has an outer metallic shell 19 made in two parts, an upper part 31 and a lower part 32. The lower part 32 includes an integral flange 26, shown in FIGS. 1-3, which has, in the upper portion thereof, a slot 28 and a pair of recesses 30 facing a seam between the halves 3 and 32, which are engaged by projecting portions 39 and 41 facing the seam of the upper part 31 of the shell 19. The details of the projecting portions 39 and 41 can be seen in FIG. 3 in relation to the slot 28 and recesses 42 of the lower part 32 of the shell 19. In the floor of the lower part 32 of the shell 19 is the coaxial port shown as 34 in FIG. 2 which includes a socket 35 and a signal contact 66 which has an end 68 projecting into the socket 35 to define the port 34. Both contacts 64 and 66 are supported within the shell 19 by dielectric core elements 50 and 51 in a manner to be described.

Figure 5:
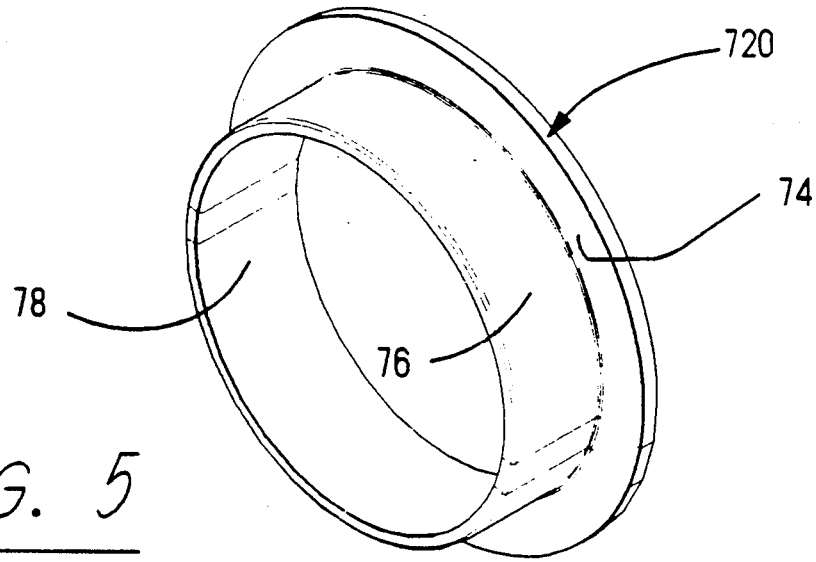
FIG. 5 is a perspective, considerably enlarged, of the locking ring utilized to hold the connector of the invention parts together.

The shell halves 31 and 32 extend opposite to the end 20 to define a further metallic portion 36, coaxial in nature, and of a reduced diameter. The portion 36 extends from a vertical wall 38 and as can be seen in FIGS. 2 and 3, the shell halves 31 and 32 define an interior volume 40. Along the edges of halves 31 and 32, as shown in FIG. 3, are recesses 42 facing a seam between the halves 31 and 32 into which fit projections 43 facing the seam which are part of half 31. The projections 41 and 43, fitting in the recesses 30 and 42, interlock and substantially shield the interior volume 40 from radiation external to the shell 19 and from radiation out of the shell 19 from the signal paths contained there within. FIG. 5 shows a metallic ring 72 including a flange 74 and a sleeve 76 having an inner surface 78 which slides over halves 31 and 32 of the port 44 to lock the halves together. Thin raised ribs 46 extend axially over the outer surface of the port 44 and establish an interference fit with the ring 72.

Figure 4:
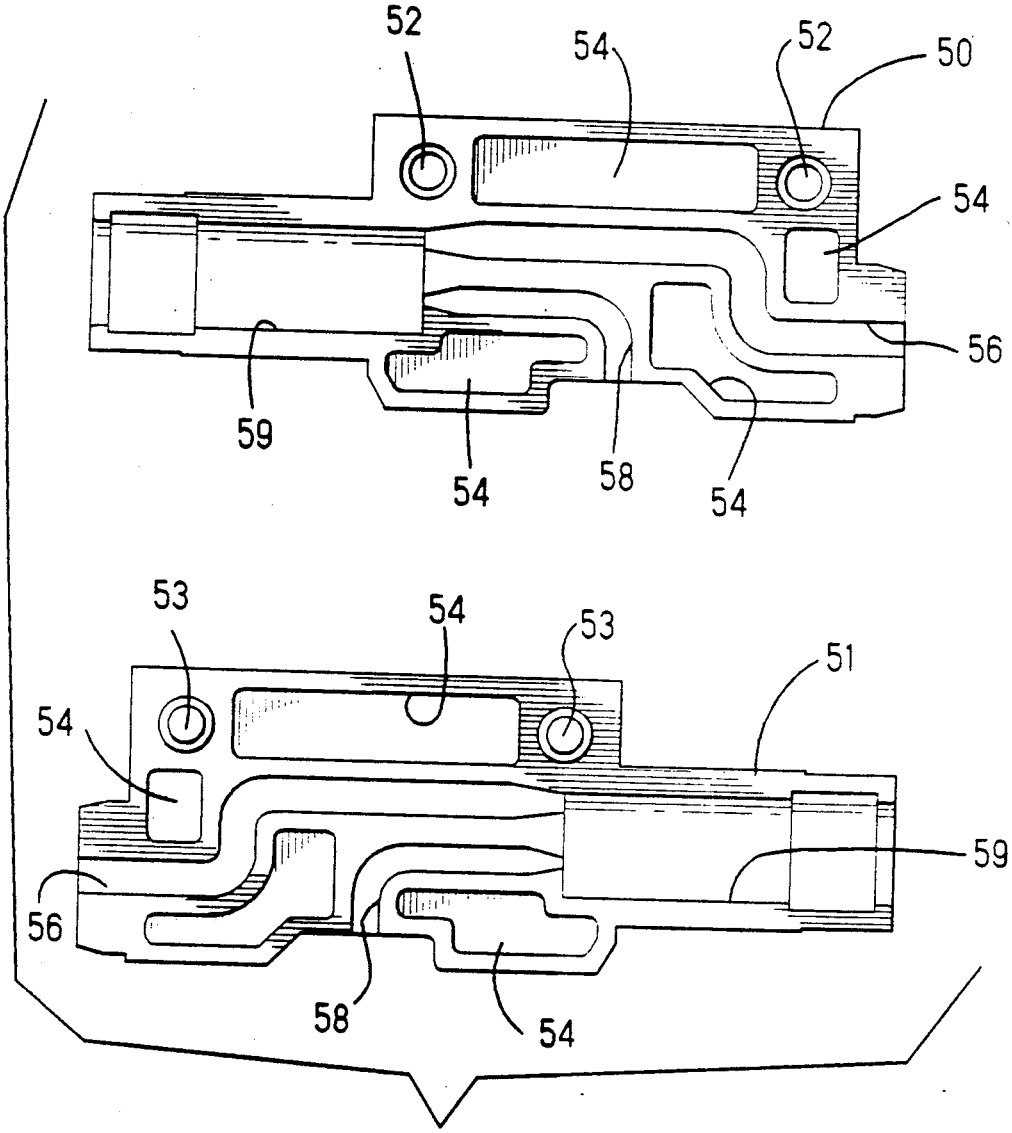
FIG. 4 is a side elevational view of the interior of the two halves of the dielectric core of the connector of the invention.

Referring again to FIG. 2, a dielectric core 49 is shown fitted within the halves 31 and 32 to substantially fill the volume 40 thereof. Core 49 is comprised of mating halves formed by care elements 50 and 51, shown in FIG. 4, to include recesses 52 toward the top thereof and projections 53 which fit in such recesses 52 and align elements 50 and 51. Interiorly of elements 50 and 51 are cavities 54 which reduce the mass of which the elements are made, and substitute such with air, altering the composite dielectric constant of the elements 50 and 51. The elements further include split passages 56 and 58 which cooperate to enclose contacts 64 and 66, fitted therein and held therein when elements 50 and 51 are put together. The rear end of the dielectric core 49, as shown in FIG. 2, may be seen to include a split central aperture 59 which leads to port 44 in the shell 19, and intersects passages 56 and 58.

Figure 6:
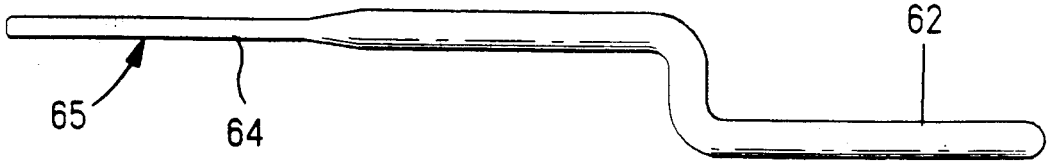
FIG. 6 is a side and elevational view of one spring contact of the invention.
Figure 7:
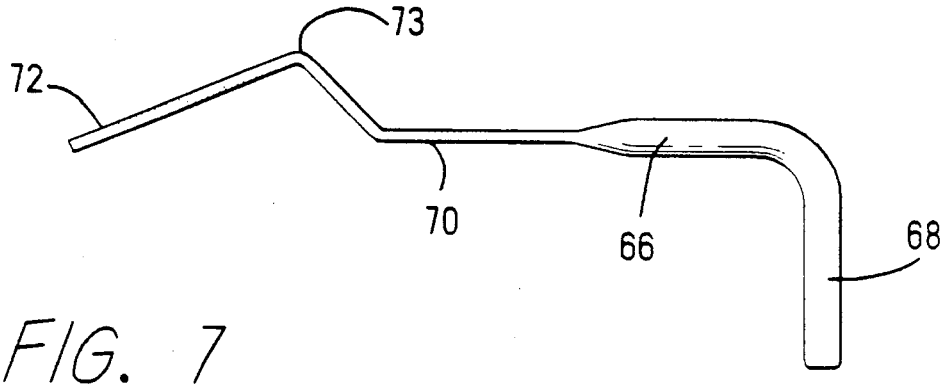
FIG. 7 is a side elevational view of the second contact of the invention.

FIGS. 6 and 7 show the contacts 64 and 66 of the connector switch 18 of the invention. The contact 66, which is the lower contact in the structure shown in FIG. 2, includes an end 68 which is cylindrical and forms part of the lower coaxial RF port 34 of the device of the invention. The end 68 is joined by a flattened portion 70 and terminates in a further flattened end portion 72 bent at an angle to define a contact point 73. The portion 72, as can be appreciated from FIG. 2, has an upper surface which receives and engages pin 69 to be deflected downwardly to disengage and separate the contact point 73 from engagement with contact 64. Contact 66 is preferably made of spring grade round wire, flattened as indicated, to define a resilient spring. The flattened portion 70 can be made a little more than twice the diameter of the wire. In one embodiment the wire was on the order of 0.025 inches in diameter. Contact 64 is made of spring grade wire with one end, end 62, rounded to form part of the port 21 as described, and the other end 65 flattened to include an undersurface 65 which is engaged by the contact point 73 of the contact 66. Both pins are suitably plated as by a gold finish over nickel underplate and, considering the spring characteristics of the contacts, held by the dielectric core elements 50 and 51 in an engagement of sufficient normal force to provide a low resistance, stable interconnection in the normally closed position shown in FIG. 2, and to withstand repeated connections and disconnections due to the insertion or withdrawal of pin 69.

Figure 8:
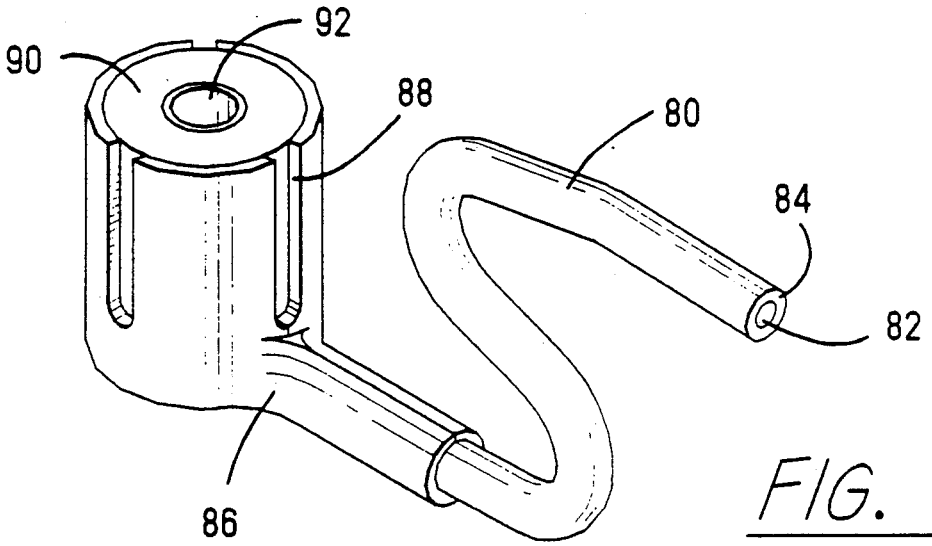
FIG. 8 is a perspective of a coaxial connector utilized with the connector of the invention.

FIG. 8 shows an end of a coaxial cable 80 which includes a center conductive wire 82 surrounded by a dielectric and insulating material 84 and a suitable shield (not shown). At the end of this wire 82 is a metallic shielding shell 86 which is slotted as at 88 to provide a spring action and includes concentrically thereof a dielectric core 90 and a center contact 92 which is terminated, in a manner not shown, to the conductive core 82 of the wire. This cable 80 goes into the port 34, fitting in socket 35 with the contact 92 engaging pin end 68. The cable 80 an electronic package, not shown, and conducts RF energy to and from such package.

In assembling the connector switch 18 of the invention, the contacts 64 and 66 are loaded into one of the dielectric core elements, as for example, into half 50 with the opposite half 51 fitted thereover, and the two halves 50 and 51 are then positioned within the lower shell portion 32 of shell 19 with the upper portion 31 then assembled to cover the elements 50 and 51. Thereafter, the ring element 72 shown in FIG. 5 is press fit over the outside of the shell ends 36 in the manner shown in FIG. 2 to wedge the two shell halves 31 and 32 together. In such condition, the dielectric core elements 50 and 51 are tightly held to retain the contacts 64 and 66 in the position shown in FIG. 2.

I claim:

1. A connector/switch of a type utilized to interconnect and disconnect RF signal ports through a switching action comprising a shell formed of box-like metallic parts having interesting edges to provide a shielding structure, a dielectric core having an exterior configuration to fit within said shell to provide dielectric parameters of an RF transmission path through said shell, the said core having interior dimensions to grip and hold a pair of contacts within said shell insulated therefrom, the pair of contacts each having one end forming a coaxial port in conjunction with said shell and said dielectric core and a second and in engagement forming a normally closed switch internally of said shell, said shell including an aperture axially aligned with said contacts second ends and said core being relieved internally to facilitate displacement of said second ends to allow said ends to be displaced relatively to effect a switch action, the said aperture positioned to receive the insertion of a pin element engaging said contacts to effect said displacement and upon withdrawal facilitate the restoration of an interconnection between said contacts to connect said ports electrically for RF energy transfer characterized in that one of said ports includes an interior threading adapted to receive the exterior threading of a coaxial connector connected to an antennae to support such antennae in a freestanding relationship relative to said connector switch.

2. The connector switch of claim 11 wherein both said contacts are formed of round wire of spring grade material having the ends flattened to assure an effective interconnection area therebetween.

3. A connector/switch of a type utilized to interconnect and disconnect F signal ports through a switching action comprising a shell formed of box-like metallic pas having interesting edges to provide a shielding structure, a dielectric ore having an exterior configuration to fit within said shell to provide dielectric parameters of an RF transmission path through said shell, the said core having interior dimensions to grip and hold a pair of contacts within said shell insulated therefrom, the pair of contacts each having one end forming a coaxial port in conjunction with said shell and said dielectric core and a second end in engagement forming a normally closed switch internally of said shell, said shell including an aperture axially aligned with said contacts second ends and said core being relieved internally to facilitate displacement of said second ends to allow said ends to be displaced relatively to effect a switch action, the said aperture positioned to receive the insertion of a pin element engaging said contacts to effect said displacement and upon withdrawal facilitate the restoration of an interconnection between said contacts to connect said ports electrically for RF energy transfer characterized in that one of said ports has an exterior threading to facilitate the mounting of said connector switch to a panel having an aperture therein with said heading receiving a nut to lock said connector switch to said panel.

4. A connector/switch of a type utilized to interconnect and disconnect RF signal pots through a switching action comprising a shell formed of box-like metallic parts having interesting edges to provide a shielding structure, a dielectric core having an exterior configuration to fit within said shell to provide dielectric parameters of an RF transmission path through said shell, the said core having interior dimensions to grip and hold a pair of contacts within said shell insulated therefrom, the pair of contacts each having one end forming a coaxial port in conjunction with said shell and said dielectric core and a second end in engagement forming a normally closed switch internally of said shell, said shell including an aperture axially aligned with said contacts second ends and said core being relieved internally to facilitate displacement of said second ends to allow said ends to be displaced relatively to effect a switch action, the said aperture positioned to receive the insertion of a pin element engaging said contacts to effect said displacement and upon withdrawal facilitate the restoration of an interconnection between said contacts to connect said ports electrically for RF energy transfer characterized in that one of said parts includes an interior threading adapted to receive the exterior threading of a coaxial connector connected to an antennae to support such antennae in a freestanding relationship relative to said connector switch and the said shell includes portions of a wall thickness to provide support of an antennae structure mounted on one of said RF ports.

5. A connector/switch of a type utilized to interconnect and disconnect RF signal ports through a switching action comprising a shell formed of box-like metallic parts having interesting edges to provide a shielding structure, a dielectric core having an exterior configuration to fit within said shell to provide dielectric parameters of an RF transmission path through said shell the said core having interior dimensions to grip and hold a pair of contacts within said shell insulated therefrom, the pair of contacts each having one end forming a coaxial port in conjunction with said shell and said dielectric core and a second end in engagement forming a normally closed switch internally of said shell, said shell including an aperture axially aligned with said contacts second ends and said core being relieved internally to facilitate displacement of said second ends to allow said ends to be displaced relatively to effect a switch action, the said aperture positioned to receive the insertion of a pin element engaging said contacts to effect said displacement and upon withdrawal facilitate the restoration of an interconnection between said contacts to connect said ports electrically for RF energy transfer characterized in that there is included a ring element fitted over said shell parts to clamp said shell pats together at one end with the said shell interesting edges holding said shell parts together proximate the other end.

* * * * *

UNITED STATES PATENT AND TRADEMARK OFFICE

CERTIFICATE OF CORRECTION

PATENT NO. : 5,174,775
DATED : December 29, 1992
INVENTOR(S) : Norman R. Birch

It is certified that error appears in the above-indentified patent and that said Letters Patent is hereby corrected as shown below:

In the Claims

Claim 4, Column 6, Line 2 - "pots" should be --ports--

Claim 4, Column 6, Line 4 - "interesting" should be --internesting--

Claim 5, Column 6, Line 34 - "interesting" should be --internesting--

Claim 5, Column 6, Line 37 - add a comma after "shell"

Claim 5, Column 6, Line 55 - "pats" should be --parts--

Claim 5, Column 6, lines 55 and 56 - "interesting" should be --internesting--

Signed and Sealed this

Sixteenth Day of August, 1994

*Attest:*

*Attesting Officer*

BRUCE LEHMAN

*Commissioner of Patents and Trademarks*